US012139991B2

(12) United States Patent
Threadgill

(10) Patent No.: US 12,139,991 B2
(45) **Date of Patent: *Nov. 12, 2024**

(54) BLOWOUT PREVENTER SHEARING RAM

(71) Applicant: SCHLUMBERGER TECHNOLOGY CORPORATION, Sugar Land, TX (US)

(72) Inventor: Micah Threadgill, Cypress, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 107 days.

This patent is subject to a terminal disclaimer.

(21) Appl. No.: 17/604,467

(22) PCT Filed: Apr. 21, 2020

(86) PCT No.: PCT/US2020/029055
§ 371 (c)(1),
(2) Date: Oct. 18, 2021

(87) PCT Pub. No.: WO2020/219410
PCT Pub. Date: Oct. 29, 2020

(65) Prior Publication Data

US 2022/0356777 A1 Nov. 10, 2022

Related U.S. Application Data

(60) Provisional application No. 62/836,695, filed on Apr. 21, 2019.

(51) Int. Cl.
*E21B 33/06* (2006.01)

(52) U.S. Cl.
CPC ..... *E21B 33/063* (2013.01)

(58) Field of Classification Search
CPC ..... E21B 33/06; E21B 33/061; E21B 33/062; E21B 33/063
(Continued)

(56) References Cited

U.S. PATENT DOCUMENTS 998,400 A 7/1911 William
2,090,206 A 8/1937 King
(Continued)

FOREIGN PATENT DOCUMENTS

EP 2484860 A2 8/2012
EP 2484861 A2 8/2012
(Continued)

OTHER PUBLICATIONS

International Search Report and Written Opinion issued in International Patent Application No. PCT/US2020/029055 on Jul. 20, 2020; 15 pages.
(Continued)

*Primary Examiner* — Kevin F Murphy
*Assistant Examiner* — Jonathan J Waddy
(74) *Attorney, Agent, or Firm* — Kelly McKinney

(57) ABSTRACT

A blowout preventer (BOP) includes a main body comprising a bore extending therethrough and a pair of opposing upper and lower rams configured to shear a tubular extending through the bore. The upper ram includes a first sloped surface oriented crosswise to a vertical axis, the lower ram comprises a second sloped surface oriented crosswise to the vertical axis, and the first sloped surface and the second sloped surface are parallel to one another.

18 Claims, 7 Drawing Sheets

(58) Field of Classification Search
USPC ..... 251/1.1, 1.3
See application file for complete search history.

(56) References Cited

U.S. PATENT DOCUMENTS

| | | | | |
|---|---|---|---|---|
| 3,561,526 | A | 2/1971 | Meynier | |
| 3,692,316 | A | 9/1972 | Bishop | |
| 4,132,265 | A | 1/1979 | Williams, Jr. | |
| 4,132,267 | A | 1/1979 | Jones | |
| 4,347,898 | A | 9/1982 | Jones | |
| 4,537,250 | A | 8/1985 | Troxell, Jr. | |
| 5,400,857 | A | 3/1995 | Whitby et al. | |
| 6,173,770 | B1 | 1/2001 | Morrill | |
| 7,207,382 | B2 | 4/2007 | Schaeper | |
| 7,354,026 | B2 | 4/2008 | Urrutia | |
| 7,367,396 | B2 | 5/2008 | Springett et al. | |
| 7,814,979 | B2 | 10/2010 | Springett et al. | |
| 8,066,070 | B2 | 11/2011 | Springett et al. | |
| 8,162,046 | B2 | 4/2012 | Jahnke | |
| 8,167,031 | B2 | 5/2012 | Jahnke | |
| 8,353,338 | B2 | 1/2013 | Edwards | |
| 8,424,607 | B2 | 4/2013 | Springett et al. | |
| 8,443,879 | B2 | 5/2013 | Jahnke | |
| 8,443,880 | B1 | 5/2013 | Jahnke | |
| 8,464,785 | B2 | 6/2013 | Carbaugh et al. | |
| 8,505,870 | B2 | 8/2013 | Yadav et al. | |
| 8,567,490 | B2 | 10/2013 | Van Winkle | |
| 8,602,102 | B2 | 12/2013 | Springett et al. | |
| 8,632,047 | B2 | 1/2014 | Hall et al. | |
| 8,720,564 | B2 | 5/2014 | Springett et al. | |
| 8,720,565 | B2 | 5/2014 | Springett et al. | |
| 8,720,567 | B2 | 5/2014 | Springett et al. | |
| 8,770,274 | B2 | 7/2014 | Van Winkle | |
| 8,800,954 | B2 | 8/2014 | Edwards | |
| 8,807,219 | B2 | 8/2014 | Springett et al. | |
| 9,022,104 | B2 | 5/2015 | Springett et al. | |
| 9,133,680 | B2 | 9/2015 | Edwards | |
| 9,644,444 | B2 | 5/2017 | Jurena | |
| 9,732,576 | B2 | 8/2017 | Rao et al. | |
| 9,739,109 | B2 | 8/2017 | Kroesen | |
| 9,822,602 | B2 | 11/2017 | Bleck et al. | |
| 9,879,498 | B2 | 1/2018 | Holland, Jr. | |
| 10,443,336 | B2 | 10/2019 | Ellison | |
| 10,550,660 | B2 | 2/2020 | Carbaugh et al. | |
| 2007/0246215 | A1 | 10/2007 | Springett et al. | |
| 2011/0226476 | A1 | 9/2011 | Springett et al. | |
| 2011/0226477 | A1* | 9/2011 | Springett | E21B 33/063 166/298 |
| 2012/0067563 | A1 | 3/2012 | Jellison | |
| 2012/0073816 | A1 | 3/2012 | Springett et al. | |
| 2012/0193087 | A1 | 8/2012 | Hall et al. | |
| 2012/0193556 | A1* | 8/2012 | Yadav | E21B 33/063 251/1.3 |
| 2013/0062540 | A1* | 3/2013 | Jurena | E21B 33/062 251/1.3 |
| 2013/0119283 | A1 | 5/2013 | Jahnke | |
| 2013/0153204 | A1 | 6/2013 | Carbaugh et al. | |
| 2014/0110611 | A1* | 4/2014 | McClanahan | E21B 33/063 251/1.3 |
| 2016/0138356 | A1 | 5/2016 | Ellison | |
| 2016/0258238 | A1 | 9/2016 | Vargas et al. | |
| 2016/0298409 | A1 | 10/2016 | Kroesen et al. | |
| 2016/0312564 | A1 | 10/2016 | Holland, Jr. | |
| 2017/0058628 | A1 | 3/2017 | van Wijk et al. | |
| 2020/0332617 | A1 | 10/2020 | Nault et al. | |
| 2022/0213757 | A1* | 7/2022 | Threadgill | E21B 33/063 |

FOREIGN PATENT DOCUMENTS

| | | | |
|---|---|---|---|
| EP | 2535509 | A2 | 12/2012 |
| EP | 3187681 | B1 | 5/2019 |
| FR | 3105041 | A1 | 6/2021 |
| GB | 2553430 | A | 3/2018 |
| WO | 2020029059 | A1 | 2/2020 |
| WO | 2020169714 | A1 | 8/2020 |
| WO | 2020219410 | A1 | 10/2020 |

OTHER PUBLICATIONS

International Search Report and Written Opinion issued in International Patent Application No. PCT/US2020/015787 on May 27, 2020; 16 pages.
Extended Search Report issued in European Patent Application No. 20794690.6 dated Dec. 2, 2022, 5 pages.
Extended Search Report issued in European Patent Application No. 20794376.2 dated Jan. 4, 2023, 6 pages.

* cited by examiner

BLOWOUT PREVENTER SHEARING RAM

CROSS-REFERENCE TO RELATED APPLICATION

This application claims priority to and the benefit of U.S. Provisional Patent Application No. 62/836,695, entitled "High-Strength Blowout Preventer Shearing Ram" and filed Apr. 21, 2019, which is hereby incorporated by reference it its entirety for all purposes.

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies invest significant amounts of time and money in finding and extracting oil, natural gas, and other subterranean resources from the earth. Particularly, once a desired subterranean resource, such as oil or natural gas, is discovered, drilling and production systems are employed to access and extract the resource. These systems may be located onshore or offshore depending on the location of the resource. Such systems generally include a wellhead assembly through which the resource is extracted. These wellhead assemblies may include a wide variety of components, such as various casings, valves, fluid conduits, and the like, that control drilling or extraction operations.

BRIEF DESCRIPTION OF THE DRAWINGS

Various features, aspects, and advantages of the present disclosure will become better understood when the following detailed description is read with reference to the accompanying figures in which like characters represent like parts throughout the figures, in which.

DETAILED DESCRIPTION OF THE DISCLOSED EMBODIMENTS

Figure 1:
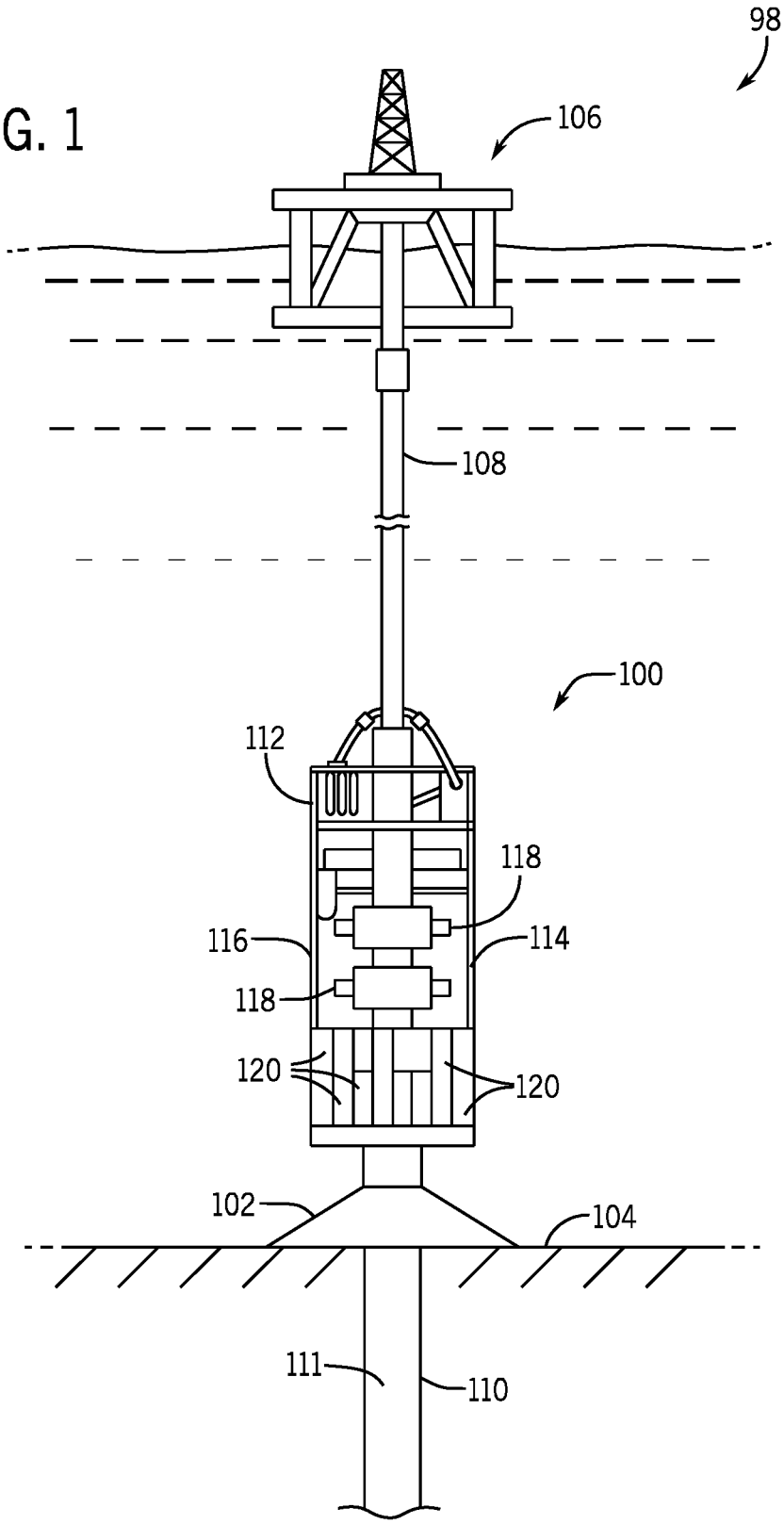
FIG. 1 is a schematic diagram of a drilling system having a blowout preventer (BOP) stack assembly, in accordance with various embodiments of the present disclosure.

The following discussion is directed to various embodiments of the present disclosure. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but are the same structure or function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus, should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," and variations of these terms is made for convenience, but does not require any particular orientation of the components. Numerical terms, such as "first," "second," and "third" are used to distinguish components to facilitate discussion, and it should be noted that the numerical terms may be used differently or assigned to different elements in the claims.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

The present disclosure is directed to a drilling system configured to access resources in the earth. The drilling system may suspend a tubular (e.g., a drill string) through a wellbore in a field (e.g., a hydrocarbon field) to access the resources. The drilling system may include a wellhead assembly configured to control fluid flow (e.g., formation fluid, drilling fluid) through an annulus formed between the tubular and a casing that lines the wellbore. The wellhead assembly may include a blowout preventer (BOP) that may control pressure and either allow or block across the BOP. For example, the BOP may be actuated to seal the annulus during rapid buildup of pressure or fluid flow within the annulus, thereby blocking the fluid flow through the BOP and the wellhead assembly to protect drilling equipment positioned above the BOP.

In some embodiments, the BOP may be a ram-type BOP that includes rams (e.g., shear rams) that are operated (e.g., hydraulically actuated, electromechanically actuated) to shear the tubular contained within a bore of the BOP and in some cases to seal the wellbore. The rams may be driven into and out of the bore of the BOP via operating pistons that are coupled, via ram shafts, to ram blocks. The rams may be grouped in opposing pairs, and opposing rams may be forced together to engage and shear the tubular. Upon shearing the tubular, the opposing rams may engage one another to seal the wellbore, thereby blocking the fluid flow through the wellbore (e.g., through the bore of the BOP).

Embodiments of the present disclosure include the BOP having the bore and the opposing rams configured to facilitate shearing the tubular extending through the bore. For example, the opposing rams may have a geometry (e.g., a profile) that guides the tubular to be positioned within one of a plurality of recesses or pockets of the opposing rams. Placement in one of the plurality or recesses may maintain the tubular in a desirable position in the bore to enable the opposing rams to shear the tubular (e.g., to enable a prominent point of the opposing rams to pierce the tubular), thereby improving shearing the tubular that is initially located at any position, such as a centered position or an off-center position, within the bore. Furthermore, each of the opposing rams may include a respective sloped surface configured to engage the tubular. The geometry of the sloped surfaces may facilitate shearing the tubular. For example, the respective sloped surfaces of the opposing rams may be parallel to one another to impart an increased amount of tensile load onto the tubular and improve shearing of the tubular. In general, the geometry of the opposing rams may increase a capability of the opposing rams to shear large diameter tubulars and tool joints, for example. Indeed, the opposing rams disclosed herein may be configured to shear the tubular without regard to a diameter of the tubular, a wall thickness of the tubular, and/or any hard-banding that may be in a cutting plane of the opposing rams.

Certain aspects of some embodiments disclosed herein are set forth below. It should be noted that these aspects are presented merely to provide the reader with a brief summary of certain forms the disclosure might take and that these aspects are not intended to limit the scope of the disclosure. Indeed, the disclosure may encompass a variety of aspects that may not be set forth below.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

Turning now to the drawings, FIG. 1 is a schematic diagram of an embodiment of a drilling system 98 (e.g., a subsea hydrocarbon drilling system) having a blowout preventer (BOP) stack assembly 100 assembled onto a wellhead assembly 102 on a sea floor 104. The BOP stack assembly 100 is connected in line between the wellhead assembly 102 and a floating rig 106 through a subsea riser 108. The BOP stack assembly 100 provides pressure control of drilling/formation fluid in a wellbore 110, which is engaged by a tubular 111 (e.g., drill string) of the drilling system 98 extending through the BOP stack assembly 100. For example, the BOP stack assembly 100 may be operated to mitigate a sudden surge of pressurized fluid flow within the wellbore 110. The BOP stack assembly 100 thus protects the floating rig 106 and the subsea riser 108 from fluid exiting the wellbore 110.

The BOP stack assembly 100 may include a lower marine riser package 112 that connects the subsea riser 108 to a BOP stack package 114. The BOP stack package 114 may also include a frame 116, BOPs 118, and accumulators 120 that may be used to provide backup hydraulic fluid pressure for actuating the BOPs 118. The BOPs 118 may include multiple types of rams that are each designed to seal the wellbore 110 in a different manner. For example, the BOPs 118 may include a ram-type BOP having shear rams to shear the tubular 111, a ram-type BOP having blind rams to seal a hollow section of the wellbore 110, a ram-type BOP having pipe rams, and/or an annular BOP having an annular sealing element to seal the wellbore 110 around the tubular 111, other suitable rams, or any combination thereof. When a pressure surge is detected in the wellbore 110, some or all of the BOPs 118 may be activated to seal the wellbore 110 to block the impact of the pressure surge on other drilling equipment, such as equipment above the BOP stack assembly 100 (e.g., the subsea riser 108).

Figure 2:
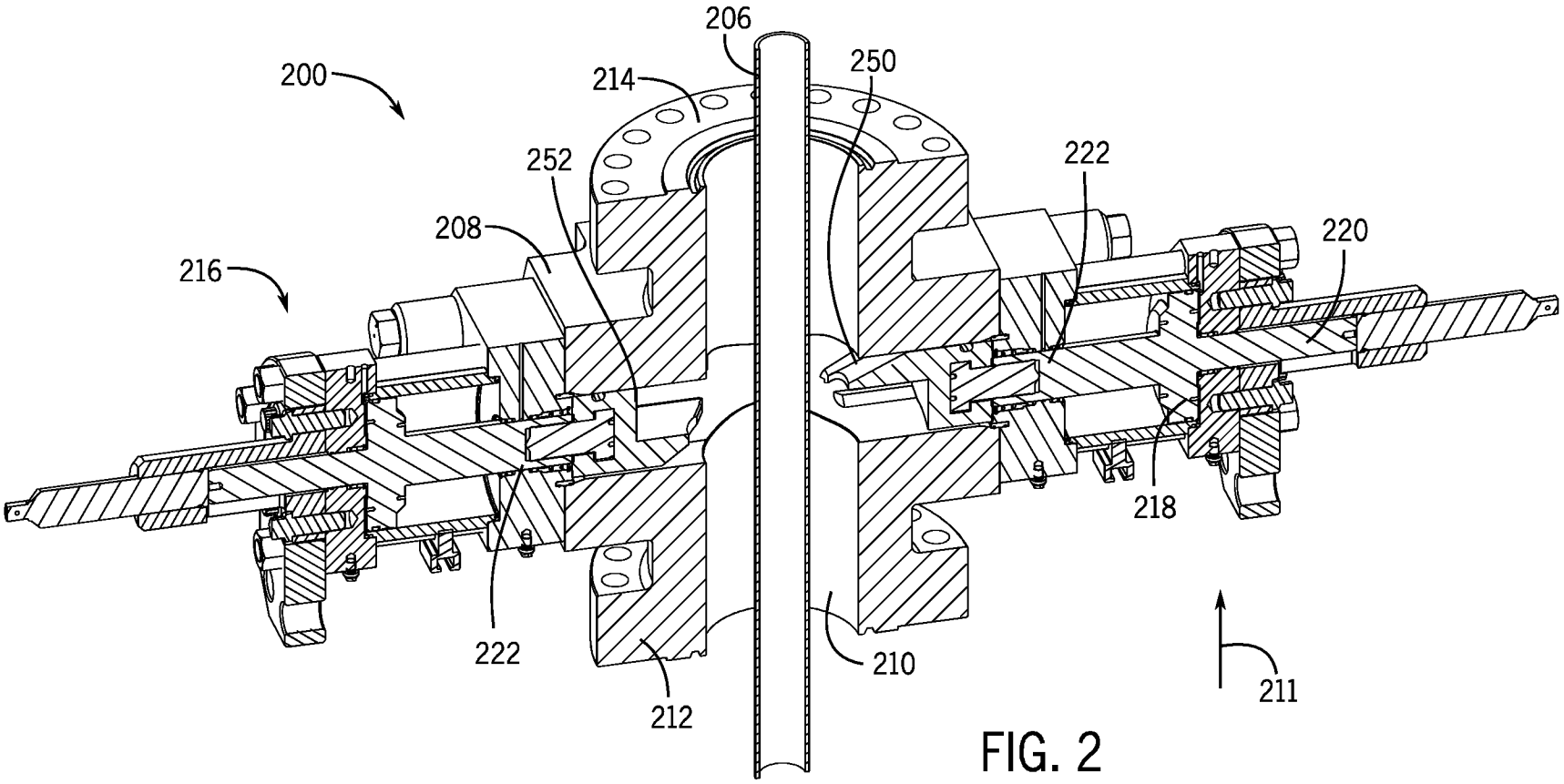
FIG. 2 is a cross-sectional perspective view of a BOP that may be used in the BOP stack assembly of FIG. 1, in accordance with various embodiments of the present disclosure.

FIG. 2 is a cross-sectional perspective view of an embodiment of a BOP 200, which may be a shear ram-type BOP. The BOP 200 may be included in a blowout preventer stack assembly, such as the BOP stack assembly 100 illustrated in FIG. 1. The BOP 200 includes a pair of opposing rams 202, 204 (e.g., shear rams, upper and lower rams). The rams 202, 204 may be actuated (e.g., hydraulically, electromechanically) to be driven together. When driven together, the rams 202, 204 may shear a tubular 206 (e.g., a drill string, a tool joint, a drill collar, a production tubular, hard-banded pipe, casing tubular) that extends through a wellbore between the rams 202, 204. For example, the BOP 200 includes a hollow (e.g., partially hollow) main body 208 having a bore 210 (e.g., a main bore, a central bore) that allows fluids (e.g., drilling fluids, completion fluids, treating fluids, produced fluids) or devices (e.g., the tubular 206) to pass through the BOP 200, such as along a vertical axis 211. he depicted BOP 200 may be mounted on a wellhead or another component by way of a lower connection 212 and/or an upper connection 214. In some embodiments, additional equipment (e.g., a subsea connector, a mandrel for connection to a lower marine riser package) may be installed on the BOP 200 via the upper connection 214 of the blowout preventer 200. In additional or alternative embodiments, the depicted BOP 200 may be one of several BOPs contained within the BOP stack assembly 100, and a respective BOP may be coupled to the BOP 200 via the lower connection 212 and/or the upper connection 214.

The BOP 200 may include bonnet or actuation assemblies 216 secured to the main body 208. The bonnet assemblies 216 may include various components that facilitate control and adjustment of the rams 202, 204 disposed in ram cavities 222 of the main body 208. Each bonnet assembly 216 may include a piston 218 coupled to a ram shaft 220. During operation, a force (e.g., a mechanical force, a hydraulic pressure) may be applied to the pistons 218 to drive (e.g., translate) the rams 202, 204, via the ram shafts 220 and within the respective ram cavities 222, toward one another into the bore 210 of the BOP 200. By driving the rams 202, 204 toward one another, the rams 202, 204 may impart a force onto the tubular 206 to shear the tubular 206. After the rams 202, 204 shear the tubular 206, the pistons 218 may continue to drive the rams 202, 204 into the bore 210 to engage one another and seal the bore 210, thereby inhibiting fluid flow through the BOP 200 and protecting equipment positioned above the main body 208 along the vertical axis 211. As described above, the rams 202, 204 may include a respective geometry (e.g., a profile) to facilitate positioning and shearing the tubular 206.

Figure 3:
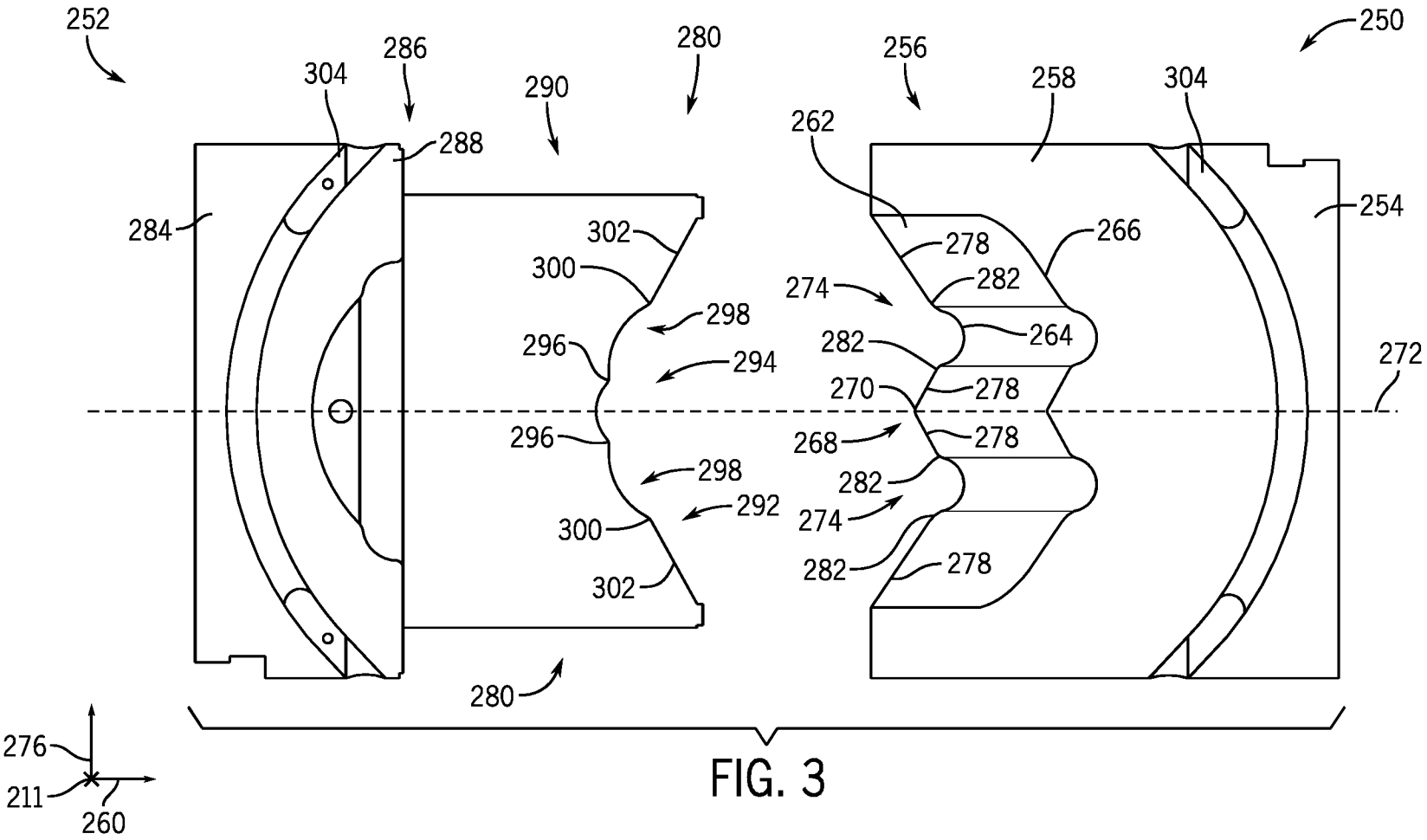
FIG. 3 is a top view of opposing rams that may be used in the BOP of FIG. 2, in accordance with various embodiments of the present disclosure.

FIG. 3 is a top view of an embodiment of a first ram 250 (e.g., an upper shear ram) and a second ram 252 (e.g., a lower shear ram) opposing one another. The opposing rams 250, 252 may be used in a BOP, such as the BOP 200 of FIG. 2. For example, the embodiment of the first ram 250 may be used as one of the opposing rams 202, 204 of the BOP 200, and the second ram 252 may be used as the other of the opposing rams 202, 204. The illustrated first ram 250 may include a first body 254, which may be coupled to a ram shaft (e.g., the ram shaft 220 of FIG. 2) to enable adjustment of the first ram 250 (e.g., to move the first ram 250 relative to the to the bore of the BOP). The first body 254 includes a substantially oblong shape in the illustrated example, but the first body 254 may include any suitable shape in additional or alternative embodiments.

A first blade section 256 (e.g., an upper blade section) may extend from the first body 254. The first blade section 256 may include a first exterior surface 258 that extends away from the first body 254 along a longitudinal axis 260. A first sloped surface 262 (e.g., a top sloped surface) may extend from the first exterior surface 258 at an angle crosswise to the vertical axis 211. That is, the first sloped surface 262 may be sloped or tapered such that, when the first ram 250 is installed within the main body of the BOP, a first vertical edge 264 of the first sloped surface 262 is positioned proximate to a medial portion of the first ram 250 along the vertical axis 211 and is closer to the bore of the BOP, and a second vertical edge 266 of the first sloped surface 262 is positioned distal from the medial portion of the first ram 250 along the vertical axis 211 and is farther from the bore of the BOP. The first sloped surface 262 may provide clearance for a tubular after the tubular is sheared, for example.

The first sloped surface 262 may terminate at the first vertical edge 264 to form a first blade surface 268. The first blade surface 268 may have a geometry (e.g., a profile) to facilitate positioning and/or shearing of the tubular extending through the bore along the vertical axis 211. The illustrated first blade surface 268 includes a blade edge 270 (e.g., a center blade edge, a vertically-extending blade edge, a prominent point), which may be aligned along a center axis 272 (e.g., symmetrical about the center axis 272) extending through the center of the rams 250, 252. The blade edge 270 may be configured to impart a force on the tubular while the tubular is centered (e.g., aligned and/or overlapping with the center axis 272 within the bore) in order to shear the tubular. To this end, the blade edge 270 may have a cutting edge or knife configured to impose a sufficient force to pierce and to shear the tubular.

In addition, the first blade surface 268 may include first recesses or pockets 274 (e.g., off-center recesses) configured to support the tubular and/or maintain a position of the tubular while the tubular is not centered within the bore of the BOP (e.g., not overlapping with the center axis 272). That is, the first recesses 274 may engage the off-center tubular to facilitate the second ram 252 with shearing the tubular. For instance, each first recess 274 may include an arcuate or other suitable shape that may enable the first blade surface 268 to capture at least a portion of the tubular, thereby blocking movement of the tubular and maintaining the position of the tubular within the bore. The illustrated first blade surface 268 includes two first recesses 274 that are positioned on opposite lateral sides of the blade edge 270 relative to a lateral axis 276 (e.g., symmetrically about the center axis 272 and the blade edge 270). However, additional or alternative embodiments of the first ram 250 may include any suitable number of first recesses 274 that are positioned in any suitable position along the lateral axis 276.

The first blade surface 268 may further include tapered surfaces 278 that are configured to guide the tubular toward one of the first recesses 274 when engaging the tubular. To this end, the tapered surfaces 278 may extend toward one of the first recesses 274 (e.g., at an angle inward toward the first body 254 with respect to the longitudinal axis 260). For instance, some of the tapered surfaces 278 may extend from the blade edge 270 into an adjacent first recess 274, and a remainder of the tapered surfaces 278 may extend from a respective lateral side 280 of the first ram 250 into an adjacent first recess 274. Thus, each of the tapered surfaces 278 may form an angle with respect to the lateral axis 276. In this manner, the tapered surfaces 278 may form a V-shape about the first recesses 274. Such geometry of the tapered surfaces 278 may urge the tubular into one of the first recesses 274. In addition, a set of the tapered surfaces 278 may capture the tubular during engagement of the first ram 250 with the tubular to maintain the tubular in or proximate to the corresponding first recess 274. As an example, first transition edges 282 positioned lateral to the first recesses 274 (e.g., formed between the first recesses 274 and the respective tapered surfaces 278) may contact the tubular to capture the tubular within one of the first recesses 274 or in front of one of the first recesses 274 (e.g., hold the tubular against the tapered surfaces 278 and/or the first transition edges 282).

The second ram 252 may also include features that complement the corresponding features of the first ram 250 and facilitate shearing of the tubular when the second ram 252 engages the tubular. As an example, the second ram 252 may include a second body 284, which may be coupled to another ram shaft to enable adjustment of the second ram 252 (e.g., to move the second ram 252 relative to the bore of the BOP). The second ram 252 may include a second blade section 286 (e.g., a lower blade section) that extends from the second body 284. The second blade section 286 may include a second exterior surface 288 that extends away from the second body 284 along the longitudinal axis 260. The second blade section 286 may also include a portion 290 (e.g., a lower portion) configured to engage the tubular extending through the bore of the BOP. The portion 290 of the second ram 252 may be configured to engage (e.g., abut, contact, seal against) the first blade section 256 of the first ram 250 when the first ram 250 and the second ram 252 engage one another, thereby sealing the bore of the BOP. For instance, the engagement between the portion 290 and the first blade section 256 may block fluid flow through the bore (e.g., in an upward direction along the vertical axis 211) between the first ram 250 and the second ram 252.

The portion 290 may include a second blade surface 292 having a geometry and/or a profile to facilitate positioning and/or shearing of the tubular. For example, the second blade surface 292 may include a second recess or pocket 294 (e.g., a center recess) aligned with the center axis 272 (e.g., symmetrical about the center axis 272). The second recess 294 may engage the tubular (e.g., a centered or substantially centered tubular) and maintain a position of the tubular along the center axis 272 as the first ram 250 and the second ram 252 move toward one another. By way of example, second transition edges 296 positioned at laterally-outer sides of the second recess 294 may engage (e.g., abut, contact, capture) the tubular to block movement of the tubular within the bore (e.g., away from the center axis 272) in order to facilitate shearing of the tubular. Indeed, the second recess 294 may be positioned opposite the blade edge 270 (e.g., opposite the prominent point) of the first ram 250 along the longitudinal axis 260. The second recess 294 may maintain the position of the tubular in the bore, thereby enabling the second transition edges 296 and/or the blade edge 270 to impart a sufficient force to pierce and to shear the tubular. Thus, while the tubular is centered, three points of loading or force (e.g., via the prominent point of the blade edge 270 and the second transition edges 296) may be provided to shear the tubular. In some embodiments, the features of the second ram 252 may hold the tubular, while the features of the first ram 250 impart the shearing force that shears the tubular.

The second blade surface 292 may further include notches or recesses 298 formed on opposite sides of the recess 294 along the lateral axis 276. Two notches 298 may, for example, be symmetrical about the recess 294 and the center axis 272. However, in additional or alternative embodiments, any suitable number of notches 298 may be formed at any location along the second blade surface 292. The notches 298 may also form third transition edges 300 on the second blade surface 292. Each third transition edge 300 of the second ram 252 may be positioned opposite a respective first transition edge 282 of the first ram 250 along the longitudinal axis 260. Accordingly, during engagement between the second ram 252 and the tubular captured within or in front of one of the first recesses 274 of the first ram 250, the corresponding first transition edges 282 and the third transition edge 300 may engage and shear the tubular. Thus, while the tubular is not centered, three points of loading or force (e.g., via the first transition edges 282 and the third transition edge 300 opposite the first transition edges 282) may be provided to shear the tubular. Accordingly, the tubular may be sheared in a point-loaded manner (e.g., with three points) regardless of position (e.g., centered or off-center) of the tubular within the bore. It should be noted that some or all of the first blade surface 268 and the second blade surface 292 (e.g., including some or all of the various transition edges) may be a cutting edge, blade edge, or knife.

The second blade surface 292 may further include lateral surfaces 302 (e.g., tapered surfaces) that are proximate to a corresponding lateral side 280. Each lateral surface 302 may extend inwardly from a corresponding lateral side 280 toward an adjacent notch 298 and an adjacent third transition edge 300 at an angle relative to the lateral axis 276. For instance, the angle of the lateral surfaces 302 relative to the lateral axis 276 may be equal to (e.g., substantially equal to) the angle of the tapered surfaces 278 of the first ram 250 relative to the lateral axis 276. In this way, each lateral surface 302 and a corresponding tapered surface 278 may be symmetric to one another about the bore of the BOP. The lateral surfaces 302 may further guide an off-center tubular into the corresponding recess 274 of the first ram 250. Indeed, the angle of the lateral surface 302 and the corresponding angle of the tapered surfaces 278 may drive the tubular (e.g., along the lateral axis 276) to one of the recesses 274 to facilitate shearing the tubular.

Each of the first ram 250 and the second ram 252 may include a respective groove 304. For example, the respective groove 304 may be formed in the first body 254 and in the second body 284. Each groove 304 may receive a respective seal element (e.g., an elastomer seal element) that blocks unwanted fluid flow across the rams 250, 252. In some embodiments, each seal element may include a material, such as a polymeric (e.g., rubber) material that induces sufficient rubber pressure during engagement to block fluid flow. Each illustrated groove 304 may span the lateral sides 280 to extend across the rams 250, 252 along the lateral axis 276. In an example, the seal element positioned within each groove 304 may engage an inner surface of the ram cavity, thereby blocking fluid flow across the first exterior surface 258 and/or across the second exterior surface 288, such as into the ram cavity and the actuation or bonnet assemblies.

Figure 4:
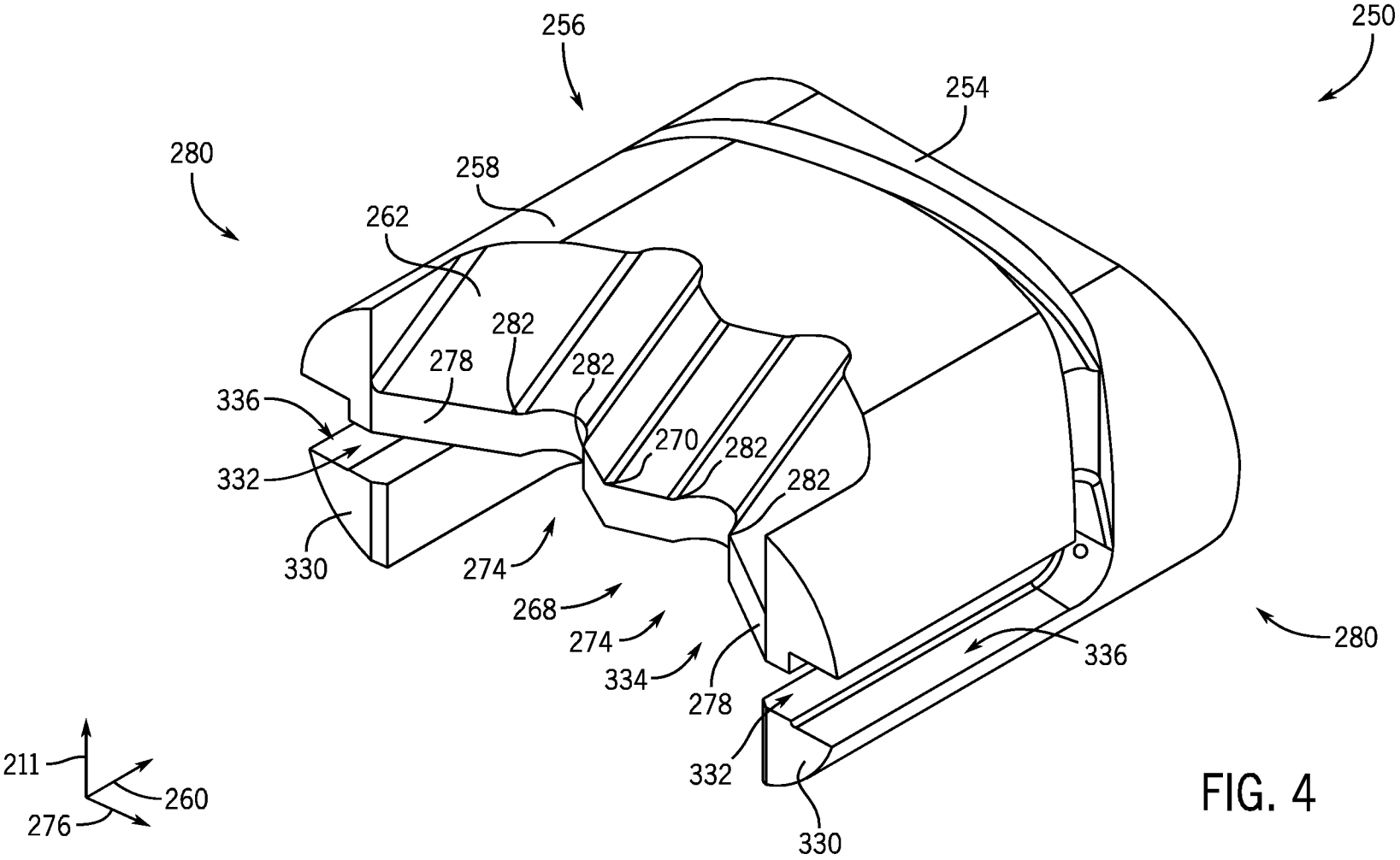
FIG. 4 is a perspective view of a first ram of the opposing rams of FIG. 3, in accordance with various embodiments of the present disclosure.

FIG. 4 is a perspective view of an embodiment of the first ram 250. The illustrated first ram 250 includes arms 330 that extend from the first body 254 of the first ram 250 along the longitudinal axis 260. Each arm 330 may be offset from the first blade section 256 along the vertical axis 211, thereby forming a slot 332 spanning between each arm 330 and the first blade section 256. The slot 332 may support a respective seal element and/or receive the portion 290 of the second blade section 286 of the second ram 252 of FIG. 3 during engagement between the first ram 250 and the second ram 252. As an example, a first interior surface 334 (e.g., a downward facing surface) of the first blade section 256 and/or a second interior surface 336 (e.g., an upward facing surface) of each arm 330 may engage (e.g., abut, contact) the portion 290. Such engagement and/or the seal element within the slot 332 may block fluid from flowing through the bore between the first ram 250 and the second ram. In the illustrated embodiment, the first ram 250 includes two arms 330 positioned proximate to the respective lateral sides 280, but in additional or alternative embodiments, the first ram 250 may include any suitable number of arms 330 having any suitable configuration, or the first ram 250 may be devoid of the arms 330.

In some embodiments, a groove may be formed on the first interior surface 334 and/or on the portion 290, and each groove may receive a seal element. As a result, engagement between the first ram 250 and the second ram 252 of FIG. 3 may cause the seal element to seal between the first interior surface 334 and the portion 290 (e.g., a surface of the portion 290) of the second ram 252. The engagement between the seal element of the first ram 250 and the portion 290 may block fluid flow between the first ram 250 and the second ram 252 (e.g., in an upward direction along the vertical axis 211), thereby blocking fluid flow through the bore when the first ram 250 is engaged with the second ram 252.

Figure 5:
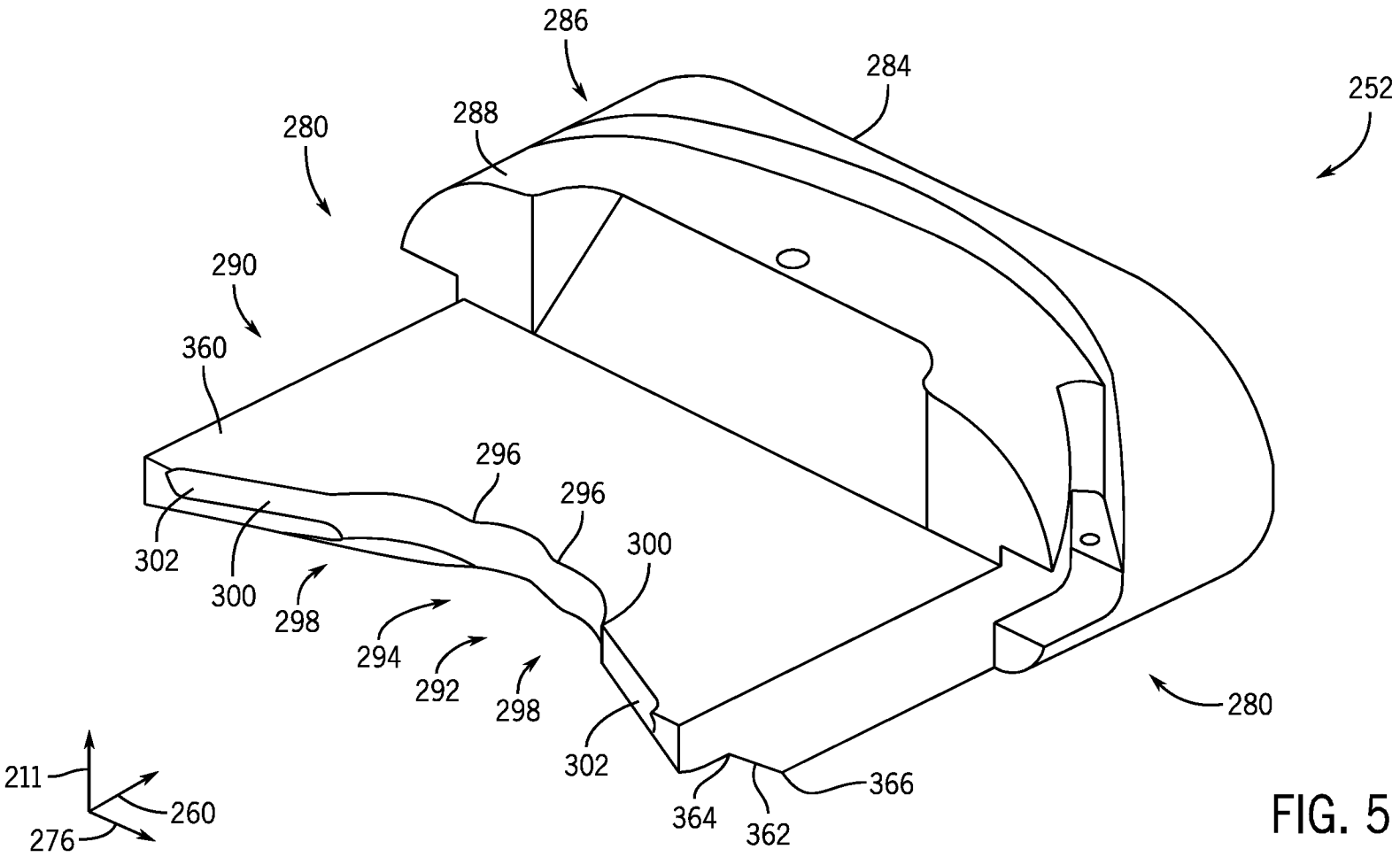
FIG. 5 is a perspective view of a second ram of the opposing rams of FIG. 3, in accordance with various embodiments of the present disclosure.

FIG. 5 is a perspective view of an embodiment of the second ram 252. The portion 290 of the second ram 252 includes a third interior surface 360 (e.g., an upward facing surface). During engagement between the second ram 252 and the first ram 250 of FIGS. 3 and 4, the portion 290 may insert between the arms 330 and/or into the slots 332, and the third interior surface 360 may engage with the first interior surface 334 (e.g., with a seal element extending between the third interior surface 360 and the first interior surface 334) of the first blade section 256 to block fluid flow between the first ram 250 and the second ram 252. In this way, the second blade surface 292 may be positioned below the first blade surface 268 of the first ram 250 of FIGS. 3 and 4. In certain embodiments, a groove may be formed along the third interior surface 360 of the portion 290 to enable a seal element to be implemented onto the third interior surface 360. In such cases, during engagement between the second ram 252 and the first ram 250 of FIGS. 3 and 4, the seal element may engage the first interior surface 334 of the first blade section 256, further blocking fluid flow between the first ram 250 and the second ram 252.

In some embodiments, the portion 290 also includes a second sloped surface 362 (e.g., a bottom sloped surface) located below the second blade surface 292 along the vertical axis 211 and extending from nearby the second blade surface 292 at an angle crosswise to the vertical axis 211. In this way, when the second ram 252 is installed within the main body of the BOP, a first vertical edge 364 of the second sloped surface 362 is positioned proximate to a medial portion of the second ram 252 along the vertical axis 211 and is closer to the bore of the BOP, and a second vertical edge 366 of the second sloped surface 362 is positioned distal from the medial portion of the second ram 252 along the vertical axis 211 and is farther from the bore of the BOP. As described below, the second sloped surface 362 may facilitate shearing the tubular with the first sloped surface 262 and/or may provide clearance for the tubular after the tubular is sheared.

Figure 6:
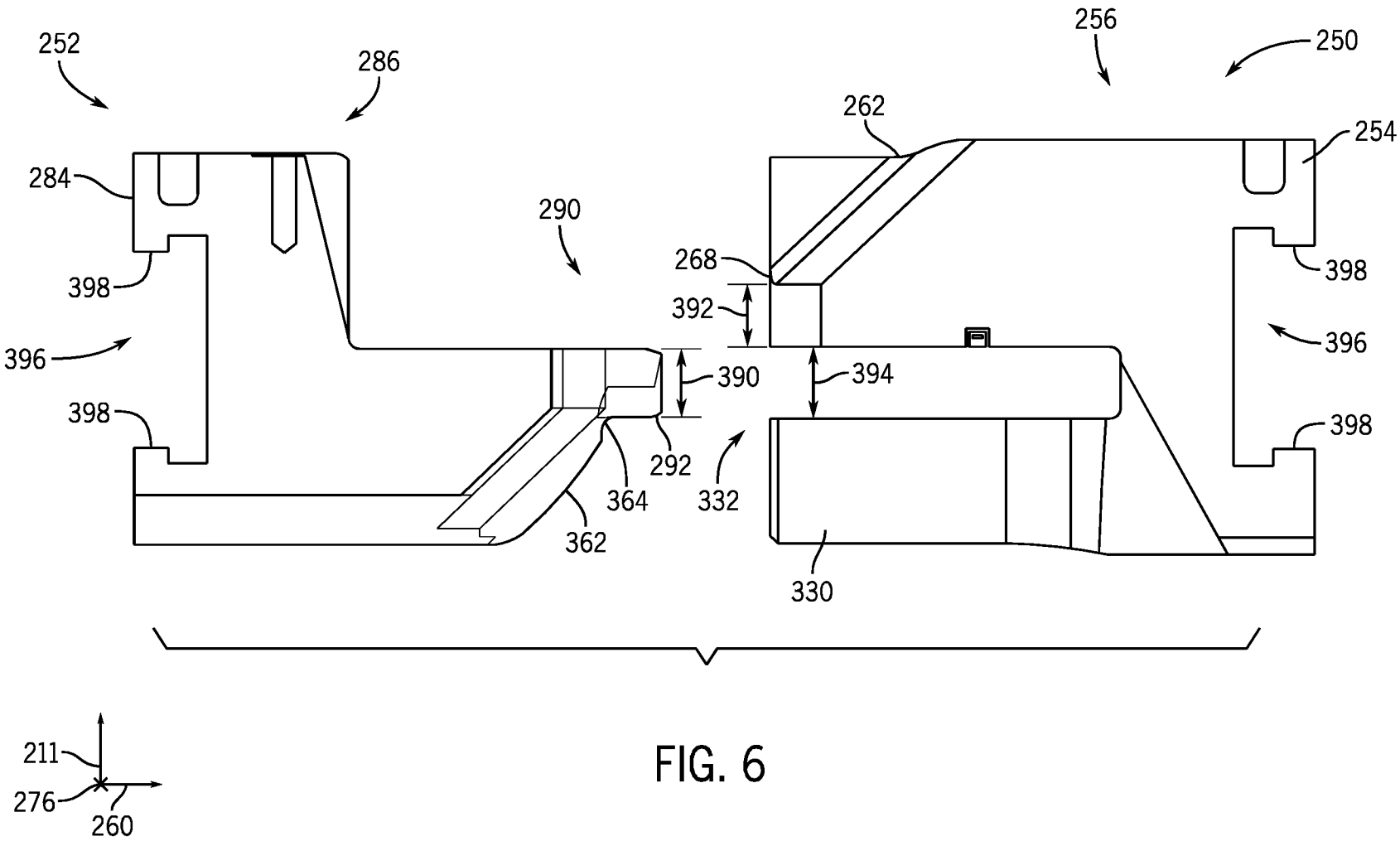
FIG. 6 is a cross-sectional side view of the opposing rams of FIG. 3, in accordance with various embodiments of the present disclosure.

FIG. 6 is a cross-sectional side view of an embodiment of the first ram 250 and the second ram 252 in which the first ram 250 and the second ram 252 are not engaged with one another. For example, the first ram 250 and the second ram 252 may be positioned in the illustrated configuration prior to and/or during engagement with the tubular (e.g., while the tubular that extends along the vertical axis 211 is positioned in a space along the longitudinal axis 260 between the first ram 250 and the second ram 252). In the illustrated embodiment, the second blade surface 292 of the second ram 252 extends past the first vertical edge 364 of the second sloped surface 362 along the longitudinal axis 260. As a result, during engagement between the second ram 252 and the tubular, the second blade surface 292 may engage the tubular before the second sloped surface 362 engages the tubular. For example, the second blade surface 292 may initiate shearing of the tubular. To this end, the second blade surface 292 may have a first thickness 390 that enables the second blade surface 292 to concentrate and impart a sufficient force to shear the tubular. In addition, during engagement between the first ram 250 and the tubular, the first blade surface 268 may engage the tubular before the first sloped surface 262 engages the tubular. Thus, the first blade surface 268 may have a second thickness 392 to enable the first blade surface 268 to concentrate and impart a sufficient force to shear the tubular. As an example, the second thickness 392 of the first blade surface 268 may be substantially equal to (e.g., within a manufacturing tolerance of) the first thickness 390 of the second blade surface 292.

In some embodiments, after initial contact with the tubular, further translation of the first ram 250 and the second ram 252 toward one another to shear the tubular may eventually cause the first sloped surface 262 and the second sloped surface 362 to engage the tubular. Indeed, the first sloped surface 262 and the second sloped surface 362 may both engage the tubular to complete the shearing of the tubular and/or facilitate complete separation of sheared portions of the tubular. To this end, the first sloped surface 262 and the second sloped surface 362 may have respective geometries to facilitate imparting a tension force on the tubular. For instance, the first sloped surface 262 and the second sloped surface 362 may be oriented at substantially the same angle (e.g., equal to or greater than a 20 degree angle, a 30 degree angle, a 40 degree angle, a 50 degree angle) relative to the longitudinal axis 260 (e.g., within a manufacturing tolerance). As such, the first sloped surface 262 and the second sloped surface 362 may be substantially parallel to one another, thereby forming a plane that facilitates shearing the tubular. Indeed, such orientation of the first sloped surface 262 and the second sloped surface 362 forming the plane may impart a sufficient tensile load to pull the sheared portions (e.g., upper and lower portions) of the tubular away from one another to facilitate completion of shearing the tubular.

Furthermore, such arrangement of the first blade surface 268 relative to the first sloped surface 262 and of the second blade surface 292 relative to the second sloped surface 362 may increase a structural integrity (e.g., a strength) of the first ram 250 and of the second ram 252, respectively. By way of example, the first blade surface 268 and/or the second blade surface 292 may extend vertically (e.g., in a direction that is substantially parallel with the vertical axis 211). Such vertical extension may enable an entirety (e.g., along the vertical axis 211) of the first blade surface 268 and/or the second blade surface 292 to contact and engage the tubular, thereby distributing a pressure across the first blade surface 268 and/or across the second blade surface 292, rather than concentrating the pressure only on a portion of the first blade surface 268 and/or the second blade surface 292. As a result, less pressure may be imparted onto the first ram 250 and/or onto the second ram 252, thereby improving the structural integrity of the first ram 250 and/or of the second ram 252.

In the illustrated embodiment, the first ram 250 and the second ram 252 are arranged to enable the second blade surface 292 to insert between the arms 330 and/or into the slot 332. In some embodiments, the slot 332 may include a height 394 that enables the slot 332 to capture the second blade surface 292, thereby blocking movement of the second blade surface 292 within the slot 332 when the first ram 250 and the second ram 252 engage one another. For instance, the height 394 may substantially match the first thickness 390 of the second blade surface 292 (e.g., within an engineering slip fit tolerance).

Furthermore, the first ram 250 and/or the second ram 252 may include respective channels 396 formed through the first body 254 and the second body 284. Each channel 396 may be used for coupling the rams 250, 252 to a corresponding ram shaft. For example, the ram shafts may include a feature that is insertable into one of the channels 396. In the illustrated embodiment, each channel 396 includes a T-shape to form lips 398. When the rams 250, 252 are coupled to the corresponding ram shaft, the lips 398 may engage a feature (e.g., a corresponding lip) of the corresponding ram shaft to block movement between the respective rams 250, 252 with the corresponding ram shaft along the longitudinal axis 260, thereby maintaining the coupling between the respective rams 250, 252 with the corresponding ram shaft.

Figure 7:
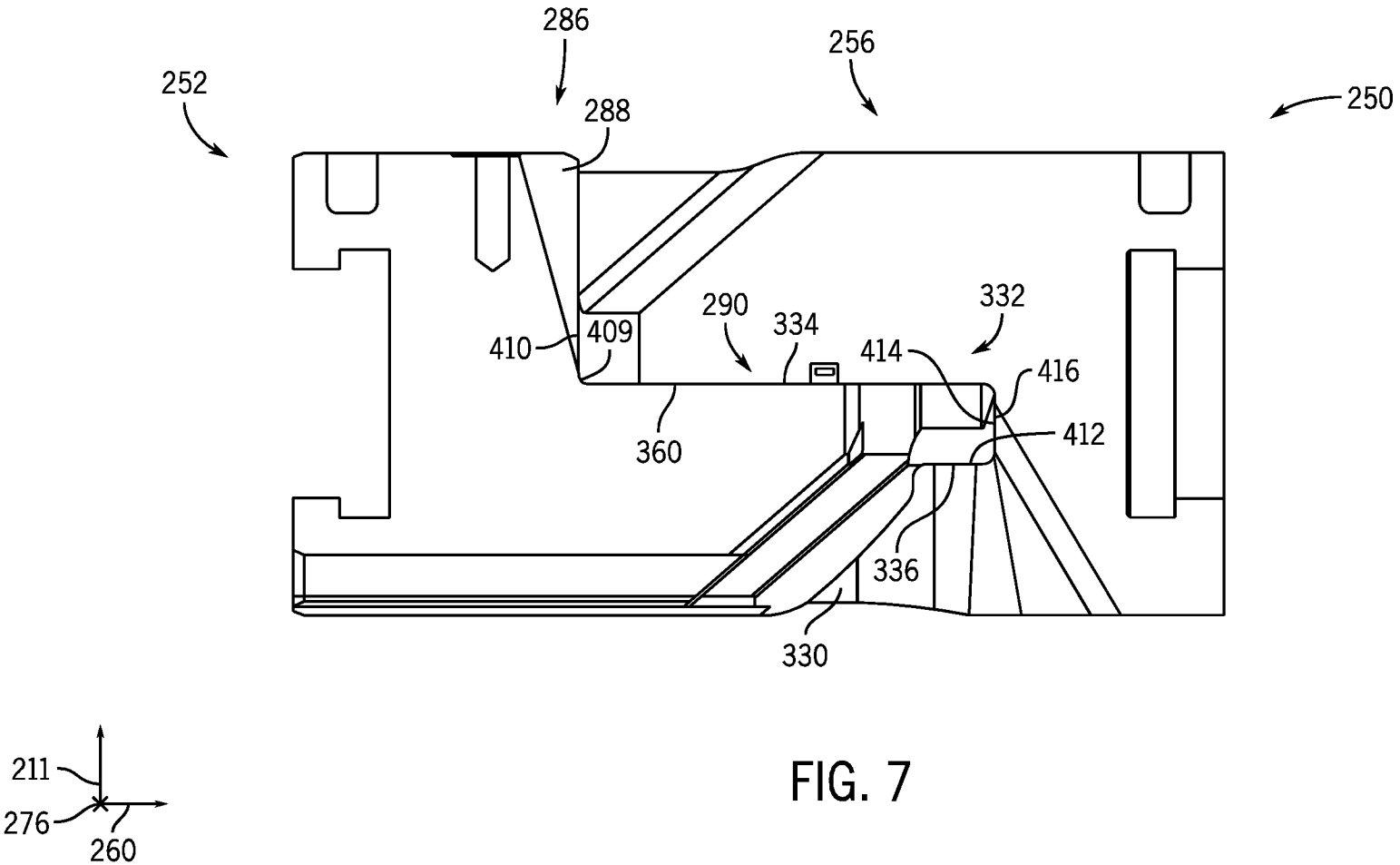
FIG. 7 is a cross-sectional side view of the opposing rams of FIG. 3, in which the opposing rams are engaged with one another, in accordance with various embodiments of the present disclosure.

FIG. 7 is a cross-sectional side view of an embodiment of the first ram 250 and the second ram 252 in an engaged configuration with one another. In the engaged configuration, the portion 290 of the second ram 252 may be inserted between the arms 330 and/or into the slot 332 of the first ram 250. For example, the first ram 250 and the second ram 252 are translated toward one another until a first surface 409 of the first blade section 256 is proximate to, in contact with, and/or abuts a second surface 410 of the second blade section 286. For instance, the second surface 410 may be a generally vertical surface extending from the second exterior surface 288 to the third interior surface 360 of the portion 290 (e.g., along the vertical axis 211). In this way, the portion 290 may be fully inserted between the arms 330 and/or against the first blade section 256. In addition to the second surface 410 abutting the first surface 409, in the engaged configuration, the third interior surface 360 of the portion 290 may abut or contact (e.g., be flush with, seal against a seal element within a groove) the first interior surface 334 of the first blade section 256, a fourth interior surface 412 (e.g., a downward facing surface) of the portion 290 may be proximate to, abut, and/or contact (e.g., be flush with) the second interior surface 336 of the slot 332, and/or a fifth interior surface 414 of the portion 290 may be proximate to, abut, and/or contact (e.g., be flush with) a sixth interior surface 416 of the first blade section 256 spanning between the arms 330 and/or the slots 332. Such engagement between the surfaces may block the fluid from flowing between the first ram 250 and the second ram 252 and/or may enable the first ram 250 and the second ram 252 to support one another.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims. While the first ram is disclosed as being the upper ram and the second ram is disclosed as being the lower ram, it should be noted that the first ram may be the lower ram and the second ram may be the upper ram (e.g., along the vertical axis).

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A pair of opposing shear rams for a blowout preventer (BOP), the pair of opposing shear rams comprising:

a first shear ram comprising a center blade edge, first recesses positioned at opposite sides of the center blade edge along a lateral axis, and first transition edges positioned at opposite sides of each of the first recesses along the lateral axis, wherein one of the center blade edge and a pair of the first transition edges positioned at the opposite sides of one of the first recesses is configured to engage a tubular extending through the BOP during engagement between the tubular and the first shear ram; and a second shear ram comprising a center recess, second recesses positioned at opposite sides of the center recess along the lateral axis, and second transition edges positioned at laterally-outer sides of the center recess along the lateral axis, wherein the center recess is configured to be positioned opposite the center blade edge of the first shear ram along a longitudinal axis, wherein the second shear ram comprises lateral surfaces each extending inwardly from a respective lateral side to one of the second transition edges, and the lateral surfaces are angled to guide the tubular toward the center recess.

2. The pair of opposing shear rams of claim 1, wherein the first shear ram comprises tapered surfaces angled inwardly toward one of the first recesses along the longitudinal axis, and the tapered surfaces are configured to guide the tubular toward one of the first recesses upon engagement with the tubular.

3. The pair of opposing shear rams of claim 1, wherein the first shear ram comprises a first blade surface comprising the center blade edge, the first recesses, and the first transition edges, the second shear ram comprises a second blade surface comprising the center recess, the second recesses, and the second transition edges, and the first blade surface is configured to be positioned above the second blade surface along a vertical axis.

4. The pair of opposing shear rams of claim 1, wherein the first shear ram comprises a first sloped surface oriented crosswise to a vertical axis, the second shear ram comprises a second sloped surface oriented crosswise to the vertical axis, and the first sloped surface and the second sloped surface are oriented at the same angle relative to the longitudinal axis.

5. The pair of opposing shear rams of claim 4, wherein the first sloped surface is above the center blade edge along the vertical axis, and the second sloped surface is below the center recess along the vertical axis.

6. The pair of opposing shear rams of claim 1, wherein the first shear ram is an upper shear ram, and the second shear ram is a lower shear ram.

7. A blowout preventer (BOP) comprising:

a bore extending therethrough and configured to receive a tubular;

an upper shear ram comprising a first sloped surface that terminates to form a first blade surface, wherein the first blade surface comprises a center blade edge, recesses positioned at opposite sides of the center blade edge along a lateral axis, and first transition edges positioned at opposite sides of each of the recesses along the lateral axis, and wherein the first sloped surface is oriented crosswise with a vertical axis and positioned above the first blade surface relative to the vertical axis; and a lower shear ram comprising a second sloped surface extending from a second blade surface, wherein the second blade surface comprises a center recess aligned along a respective center axis of the lower shear ram, notches positioned at opposite sides of the center recess along the lateral axis, and second transition edges positioned at laterally-outer sides of the center recess along the lateral axis, the lower shear ram further comprising lateral surfaces each extending inwardly from a respective lateral side to one of the second transition edges, and the lateral surfaces are angled to guide the tubular toward the center recess, the lower shear ram being configured to guide the tubular toward the center blade edge of the upper shear ram to facilitate shearing of the tubular as the upper shear ram and the lower shear ram translate toward one another along a longitudinal axis.

8. The BOP of claim 7, wherein the upper shear ram comprises an arm offset from the first blade surface along the vertical axis to form a slot spanning between the arm and the first blade surface, and a portion of the lower shear ram is configured to insert into the slot during engagement between the upper shear ram and the lower shear ram to seal the bore.

9. The BOP of claim 7, wherein the second sloped surface is positioned below the second blade surface relative to the vertical axis, and the first sloped surface and the second sloped surface are parallel to one another.

10. The BOP of claim 7, wherein the first blade surface extends along the vertical axis to reduce a pressure imparted by the tubular onto the first blade surface during engagement between the upper shear ram and the tubular.

11. A blowout preventer (BOP) comprising:

a main body comprising a bore extending therethrough; and a pair of opposing upper and lower rams configured to shear a tubular extending through the bore, wherein the upper ram comprises a first sloped surface oriented crosswise to a vertical axis, the lower ram comprises a second sloped surface oriented crosswise to the vertical axis, and the first sloped surface and the second sloped surface are parallel to one another, wherein the first sloped surface of the upper ram terminates to form a first blade surface, the first blade surface comprising a center blade edge aligned along a respective center axis of the upper ram, first recesses positioned at opposite sides of the center blade edge along a lateral axis, and first transition edges positioned at opposite sides of each of the first recesses along the lateral axis, wherein the first transition edges of the upper ram are positioned at opposite sides of each of the first recesses along the lateral axis such that each first recess corresponds to a pair of first transition edges, wherein the lower ram comprises a second blade surface comprising a center recess aligned along a respective center axis of the lower ram, notches positioned at opposite sides of the center recess along the lateral axis, second transition edges positioned at laterally-outer sides of the center recess along the lateral axis, and third transition edges formed by the notches, wherein each third transition edge of the lower ram is positioned opposite a corresponding pair of the first transition edges of the upper ram along a longitudinal axis, and wherein the lower ram further comprises lateral surfaces each extending inwardly from a respective lateral side toward an adjacent notch and an adjacent third transition edge at an angle relative to the lateral axis, and the lateral surfaces are angled to guide the tubular toward the center recess.

12. The BOP of claim 11, wherein the recesses are symmetrically positioned about the center axis of the upper ram.

13. The BOP of claim 11, wherein the center recess is configured to position the tubular along the center axis of the lower ram when engaged with the tubular.

14. The BOP of claim 13, wherein the lower ram comprises a blade section having a portion comprising the second sloped surface and the second blade surface, the upper ram comprises a slot, and the portion is configured to insert into the slot while the upper ram and the lower ram engage one another.

15. The BOP of claim 14, wherein the second sloped surface is below the second blade surface along the vertical axis.

16. The BOP of claim 11, wherein the first sloped surface is above the first blade surface along the vertical axis, and the second sloped surface is below the second blade surface along the vertical axis.

17. The BOP of claim 11, wherein the center blade edge of the upper ram and the second transition edges of the lower ram provide three points of loading force to shear the tubular while the tubular is centered.

18. The BOP of claim 11, wherein one of the third transition edges of the lower ram and the pair of first transition edges of the upper ram corresponding to the one of the third transition edges provide three points of loading force to shear the tubular while the tubular is not centered.

* * * * *